US011832694B2

(12) United States Patent
Kwon et al.

(10) Patent No.: US 11,832,694 B2
(45) Date of Patent: Dec. 5, 2023

(54) CASE FOR ROLLABLE MOBILE DEVICE

(71) Applicant: Spigen Korea Co., Ltd., Seoul (KR)

(72) Inventors: Younghee Kwon, Seoul (KR); Gang Il Park, Seoul (KR); Hee Tae Yang, Seoul (KR); Chanyeop Jeong, Seoul (KR); Seung Jun Lee, Seoul (KR)

(73) Assignee: Spigen Korea Co., Ltd., Seoul (KR)

( * ) Notice: Subject to any disclaimer, the term of this patent is extended or adjusted under 35 U.S.C. 154(b) by 0 days.

(21) Appl. No.: 17/645,050

(22) Filed: Dec. 18, 2021

(65) Prior Publication Data

US 2022/0192336 A1 Jun. 23, 2022

(30) Foreign Application Priority Data

Dec. 18, 2020 (KR) ..... 10-2020-0178435

(51) Int. Cl.
*G06F 1/16* (2006.01)
*A45C 11/00* (2006.01)

(52) U.S. Cl.
CPC ..... *A45C 11/00* (2013.01); *A45C 2011/002* (2013.01); *A45C 2011/003* (2013.01)

(58) Field of Classification Search
CPC ..... A45F 2200/0516; A45C 2011/002; A45C 2011/003; A45C 2200/15; A45C 13/002; H04B 1/3888; G06F 1/1628; G06F 1/1624; G09F 9/301
USPC ..... 206/320
See application file for complete search history.

(56) References Cited

U.S. PATENT DOCUMENTS

| | | | | |
|---|---|---|---|---|
| 8,376,581 | B2 * | 2/2013 | Auld | G09F 11/30 345/55 |
| 9,195,272 | B2 * | 11/2015 | O'Brien | G06F 1/1652 |
| 9,286,812 | B2 * | 3/2016 | Bohn | G06F 1/1624 |
| 10,064,298 | B2 * | 8/2018 | Cavenagh | H05K 5/0021 |
| 10,790,869 | B1 * | 9/2020 | Loh | A45C 11/00 |
| 11,315,443 | B2 * | 4/2022 | Han | G06F 1/1652 |
| 2009/0128785 | A1 * | 5/2009 | Silverstein | H04N 9/3173 353/119 |
| 2014/0213324 | A1 * | 7/2014 | Tan | G06F 1/1677 455/566 |
| 2016/0066453 | A1 * | 3/2016 | Quehl | A45C 11/00 206/45.2 |
| 2016/0216737 | A1 * | 7/2016 | Hayk | G06F 1/1626 |
| 2018/0188778 | A1 * | 7/2018 | Shin | G06F 1/1624 |

(Continued)

FOREIGN PATENT DOCUMENTS

| | | | |
|---|---|---|---|
| EP | 3 747 305 | A1 | 12/2020 |
| KR | 10-2016-0102106 | A | 8/2016 |

(Continued)

*Primary Examiner* — Adam J Waggenspack
(74) *Attorney, Agent, or Firm* — Bridgeway IP Law Group, PLLC; Jihun Kim

(57) ABSTRACT

The present invention relates to a case mounted on a rollable mobile device. According to the present invention, the rollable mobile device can be safely protected by the first case and the second case in response to a shape change occurring when the display is expanded or reduced in the rollable mobile device. In addition, according to the present invention, a holding part provides a force to hold the case while safely protecting the exposed portion by the extension of the display of the rollable mobile device, so that the case is not separated from the rollable mobile device.

6 Claims, 9 Drawing Sheets

(56) References Cited

U.S. PATENT DOCUMENTS

| | | | | |
|---|---|---|---|---|
| 2018/0352924 | A1* | 12/2018 | Lim | H04B 1/3827 |
| 2020/0304613 | A1* | 9/2020 | Cha | G06F 1/1652 |
| 2020/0352038 | A1* | 11/2020 | Kim | G06F 1/165 |

FOREIGN PATENT DOCUMENTS

| | | | | |
|---|---|---|---|---|
| KR | 10-2017-0025520 | A | | 3/2017 |
| KR | 10-2020-0060014 | A | | 5/2020 |
| KR | 20220124852 | A | * | 9/2022 |

* cited by examiner

CASE FOR ROLLABLE MOBILE DEVICE

CROSS-REFERENCE TO RELATED APPLICATIONS

This application claims foreign priority to Korean patent application No. 10-2020-0178435, filed on Dec. 18, 2020, the disclosures of which are incorporated herein by reference in their entirety.

FIELD OF THE INVENTION

The present invention relates to a protective case for electronic devices. Specifically, the present invention relates to such protective case for rollable mobile electronic devices.

BACKGROUND OF THE INVENTION

A mobile electronic device is a computing device that users are able to carry all the time. Since mobile devices are used by users on a daily basis, they are frequently damaged by users' careless treatments and unintentional drops. Therefore, cases to protect mobile devices are often used. This case protects the mobile device from external impact while enclosing it.

Typically, a mobile electronic device adopts a flat panel display. However, flexible displays that can be folded or bent have been developed, and flexible displays are being applied to mobile devices as well. A rollable mobile device is a mobile device that can expand the exposed display using a flexible display that can be folded or bent. Rollable mobile devices are expected to be innovative products in the IT industry as they can have a variety of uses by changing the shape of the display.

However, it is very difficult to mount a case on a rollable mobile device because the overall shape changes as the display is folded or bent. This is because it is difficult to attach a case to a portion that changes in shape due to the change in shape. In a rollable mobile device, the exposed portion of the display is particularly weak in durability, so a case that can respond to shape changes while protecting these parts is urgently needed.

SUMMARY OF THE INVENTION

The present invention enables the rollable mobile device to be safely protected in response to the shape deformation that occurs when the display is expanded or reduced in the rollable mobile device. In addition, the present invention prevents the case from being separated from the rollable mobile device while safely protecting the part exposed and expanding the display in the rollable mobile device.

A case for a rollable mobile device according to the present invention includes a first case including a first support part and a second case including a second support part.

A case for a rollable mobile device according to the present invention includes a first case and a second case, wherein the case further includes a stand unit for supporting the first case to be erected at a predetermined angle.

A case for a rollable mobile device according to the present invention includes a first case and a second case, wherein the case further includes a holding part for holding the second case so that it does not fall off.

The first case and the second case of a rollable mobile device according to the present invention may be separated from each other and at least one side is opened.

According to the present invention, the rollable mobile device can be safely protected in response to shape change that occurs when the display is expanded or reduced in the rollable mobile device by the first case and the second case.

In addition, the present invention provides a case for a rollable mobile device that includes a holding part which provides a force to prevent the case detaching from the rollable mobile device while safely protecting the portion where the display is extended and exposed in the rollable mobile device.

Even if the effect is not directly described herein, it should be understood that the effect anticipated or expected by the description of the invention is described in the effect of the invention.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

The present invention is not limited to the embodiments described below, but may be variously implemented in different forms. The examples are provided to complete the description of the present invention and to inform those skilled in the art the scope of the invention.

The terms used in the description of the invention are used to describe the embodiments, and are not intended to limit the present invention. The term 'comprises' in the description of the invention is intended to designate that there is a configuration in which the described features are combined. Therefore, it is to be understood that the existence or addition of one or more other features or combinations thereof is not excluded.

Hereinafter, when it is determined that the features of the present invention may be unnecessarily obscured as obvious to those skilled in the art, detailed descriptions of known configurations or functions will be omitted.

Figure 1:
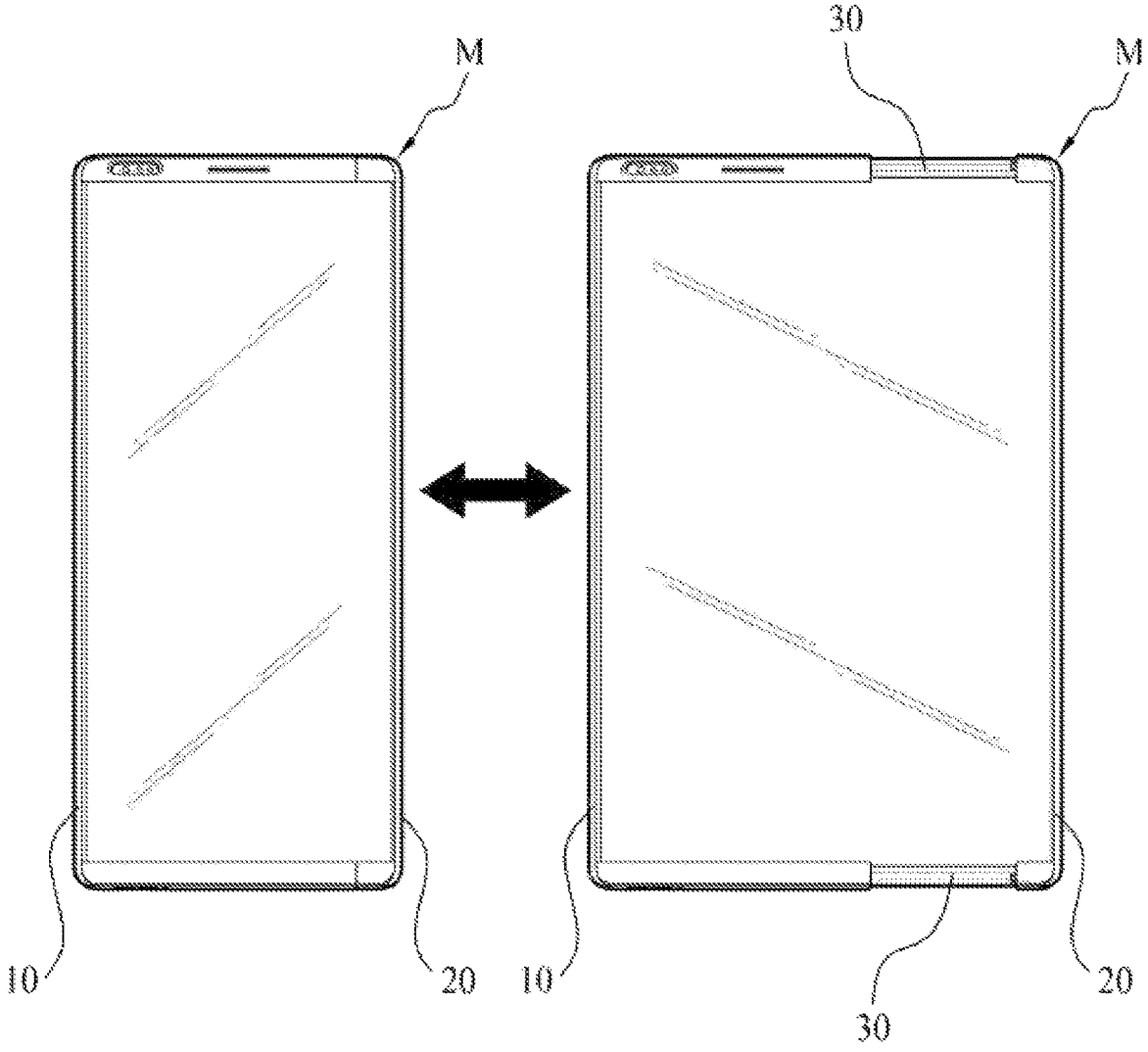
FIG. 1 shows a representative rollable mobile device.

FIG. 1 shows a rollable mobile device M. Referring to FIG. 1, a rollable mobile device M to which a case for a rollable mobile device according to an embodiment of the present invention is mounted includes a first body part 10 and a second body part 20.

In the rollable mobile device M, the first body part 10 and the second body part 20 have a configuration that does not change in shape. The rollable mobile device M may adjust the exposed area of the display according to a change in the relative positions of the first body part 10 and the second body part 20. For example, when the first body part 10 and the second body part 20 are located far from each other, as the display accommodated in the rollable mobile device M unfolds, the display expands. Conversely, when the first body part 10 and the second body part 20 are located close to each other, the display is accommodated in a bent or folded state inside the rollable mobile device M. Depending on the rollable mobile device M, based on the first body part 10, as the second body part 20 slides, the display may be expanded or reduced. Here, the exposed portion exposed by the extension of the display in the rollable mobile device M has a weak durability, but there is a problem in that it is difficult to mount the case due to the change in the shape of the rollable mobile device.

Figure 2:
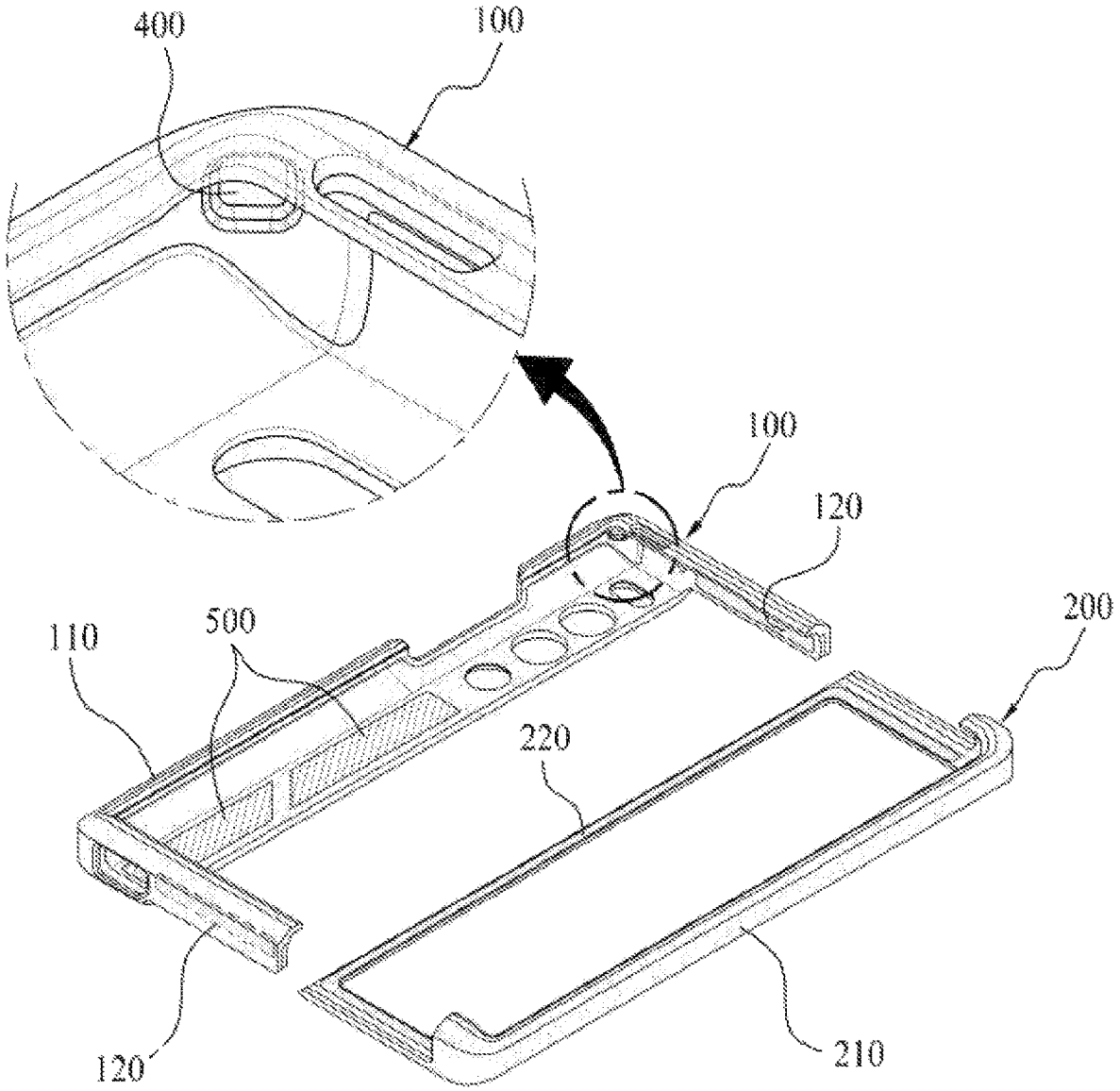
FIG. 2 shows a case for a rollable mobile device according to an embodiment of the present invention.

FIG. 2 shows a case for a rollable mobile device according to an embodiment of the present invention. Referring to FIG. 2, a case for a rollable mobile device according to an embodiment of the present invention includes a first case 100 and a second case 200.

The first case 100 is mounted on the first body part 10 of the rollable mobile device M. The first case 100 covers and protects the first body part 10. In an embodiment, the first case 100 includes a convex portion. The convex part is formed to be higher than the protrusion height of the camera module of the first body part. When the camera module is positioned in the first body part 10, scratches may occur on the camera module even when the case is mounted due to the height at which the camera module protrudes. The convex part is formed at a position corresponding to the camera module to be higher than the height of the camera module, so that the camera module can be safely protected from scratches.

The first case 100 includes an edge part 110 surrounding the edge of the first body part 10. The edge part 110 is formed higher than one surface of the first body part 10 to protect the first body part 10.

The first case 100 includes a first support part 120. The first support part 120 supports the first case 100 not to be pushed or twisted. The first support part 120 is formed in a plate shape and may be located inside the first case 100. When the edge part 110 of the first case 100 is thin in order not to cover the display of the rollable mobile device M, The edge part 110 may be easily pushed or twisted by an external force. However, if there is a support part, one side of the edge part 110 can be fixed or supported, so that the first case 100 is more stably mounted on the first body part 10 to protect the rollable mobile device M.

In an embodiment, the first support part 120 may be plural. When the first support part 120 is positioned in a portion where the first case 100 is easily pushed or twisted, the plurality of first support parts 120 can efficiently support the first case 100. In particular, when the edge part 110 of the first case 100 is thinned or the area of the case itself is reduced in order not to cover the display, the first support part 120 having a whole connected form is difficult to be placed inside the first case 100. Accordingly, if a plurality of first support parts 120 are separated and placed in various parts of the first case 100, the first support part 120 can support the first case 100 more efficiently.

Preferably, the first support part 120 may be made of a steel material. However, the first support part 120 is not limited to the above-described material, and various materials that can satisfy the strength characteristics can be used to support the first case 100.

A second case 200 is mounted on a second body part 20 of the rollable mobile device M. The second case 200 surrounds and protects the second body part 20.

The second case 200 includes an edge part 210 surrounding the edge of the second body part 20. The edge part 210 is formed higher than one surface of the second body part 20 to protect the second body part 20.

The second case 200 includes a second support part 220. The second support part 220 supports the second case 200 so as not to be pushed or twisted. In an embodiment, the second support part 220 may be plural. The second support part 220 has a function similar to that of the first support part 120, and a detailed description thereof will be omitted. However, depending on the shape of the second body part 20 mounted, the second case 200 may have a thinner edge part than that of the first case 100, or the area of the second case itself may be smaller than that of the first case 100. While the second case 200 can be pushed or twisted more easily than the first case 100, it is more difficult to position the second support part 220 inside the second case 200. Accordingly, the shape of the second support part 220 may be variously modified.

A case for a rollable mobile device according to an embodiment of the present invention includes an air room 500. The air room 500 absorbs the shock applied to the case from one side surrounding the edge of the rollable mobile device M. The air room 500 is formed in a portion in contact with the edge of the rollable mobile device M. The air room 500 is formed in a portion in contact with the edge of the first body part 10 in the first case 100, and is formed in a portion in contact with the edge of the second body part 20 in the second case 200. When an impact is applied to the case, it is possible to minimize the physical force directly transmitted to the rollable mobile device M by absorbing the impact through the empty space of the air room 500. Since the corners are particularly vulnerable to damage, the present invention protects the rollable mobile device M not only primarily by the case but also by the air room 500 secondarily.

A case for a rollable mobile device according to an embodiment of the present invention includes a pad part 600. The pad part 600 is in contact with at least a part of the rollable mobile device M. The pad part 600 absorbs the shock applied to the case. The pad part 600 is formed of a material having adhesion and flexibility to effectively support the rollable mobile device M, so it can prevent minor damage while protecting it. When the rollable mobile device M and the case come in direct contact without the pad part 600, the impact cannot be effectively absorbed. Furthermore, scratches or marks may occur on the rollable mobile device M due to the case. In the present invention, the pad part 600 effectively absorbs the impact by keeping the rollable mobile device M and the case apart from each other. In addition, the pad part 600 prevents scratches or marks on the rollable mobile device M, and at the same time improves the adhesion between the rollable mobile device M and the case to effectively reduce the gap in between.

Figure 3:
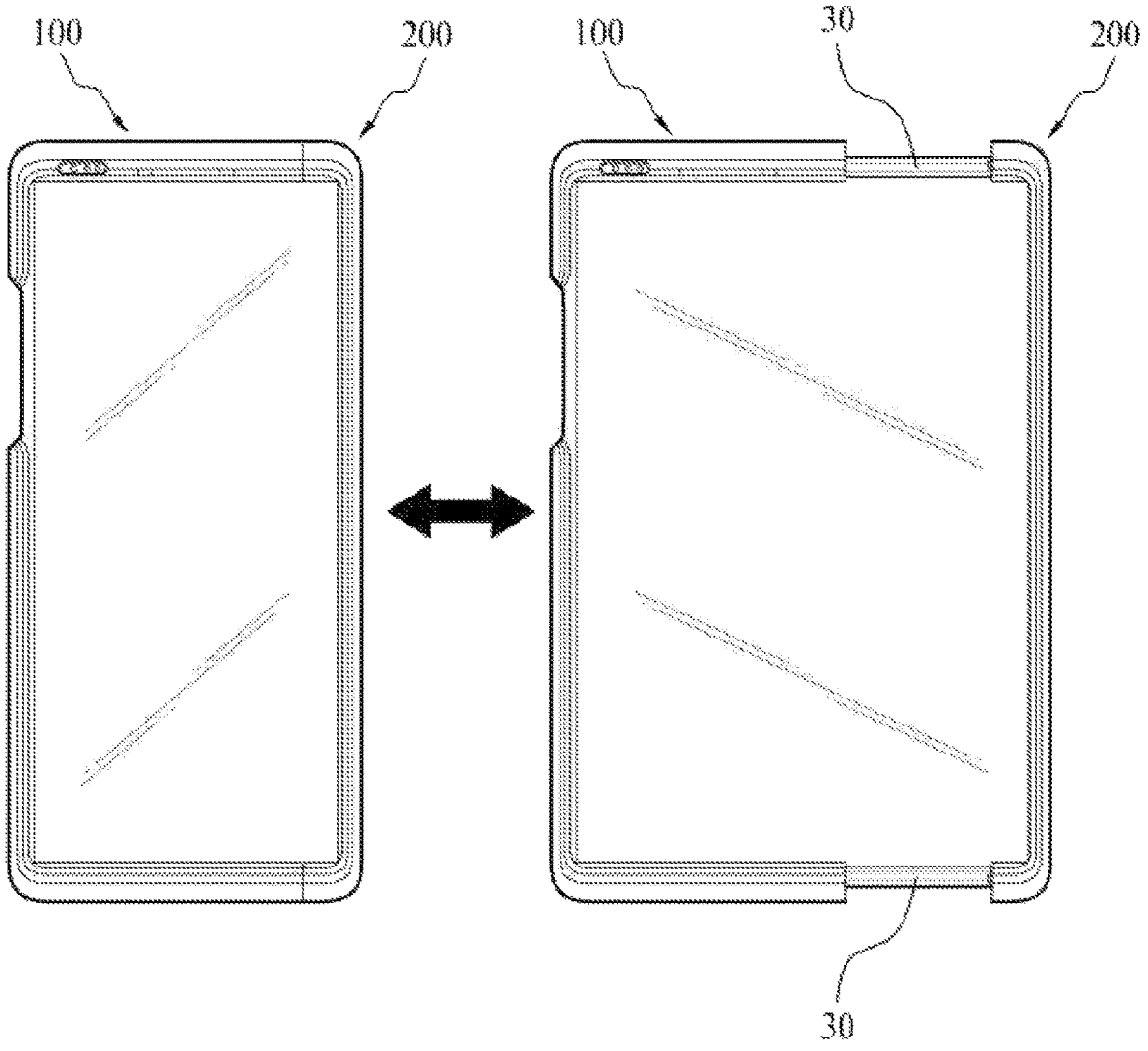
FIG. 3 is a diagram illustrating a state in which a case for a rollable mobile device according to an embodiment of the present invention is mounted on the rollable mobile device.

FIG. 3 shows a state in which a case for a rollable mobile device according to an embodiment of the present invention is mounted on the rollable mobile device M. Referring to FIG. 3, even if the shape of the rollable mobile device M is changed as the display is expanded or reduced, it can be maintained that the first case 100 and the second case 200 are mounted on the first body part 10 and the second body part 20, respectively. Here, the first support part 120 and the second support part 220 support the first case 100 and the second case 200, respectively, so that the first case 100 and the second case 200 are connected to be stably mounted on the first body part 10 and the second body part 20.

A case for a rollable mobile device according to an embodiment of the present invention may be made of hard and soft materials. Alternatively, the material may be a mixture of hard and soft materials. By mixing hard and soft materials, the case can have both hard properties to resist impact and soft properties to absorb impact. In particular, the edges of the first case 100 and the second case 200 are formed of a soft material to effectively absorb the shock applied to the case. In an embodiment, the hard material may be a polycarbonate, and the soft material may be a TPU (thermoplastic polyurethane). However, if the hard and soft characteristics are satisfied, the material used for the first case 100 and the second case 200 is not limited to the above-described material. For the mixing of hard and soft materials, the double injection technique can be applied.

A case for a rollable mobile device according to an embodiment of the present invention effectively protects the rollable mobile device M by using a combination of hard, soft and steel materials. In an embodiment of the present invention, steel is applied to the first support part 120 and the second support part 220 for supporting the case while mixing hard and soft materials in the case itself. By using various materials in consideration of the functions and effects of each configuration, it is possible to effectively protect from impact while actively responding to the shape deformation of the rollable mobile device M.

Figure 4:
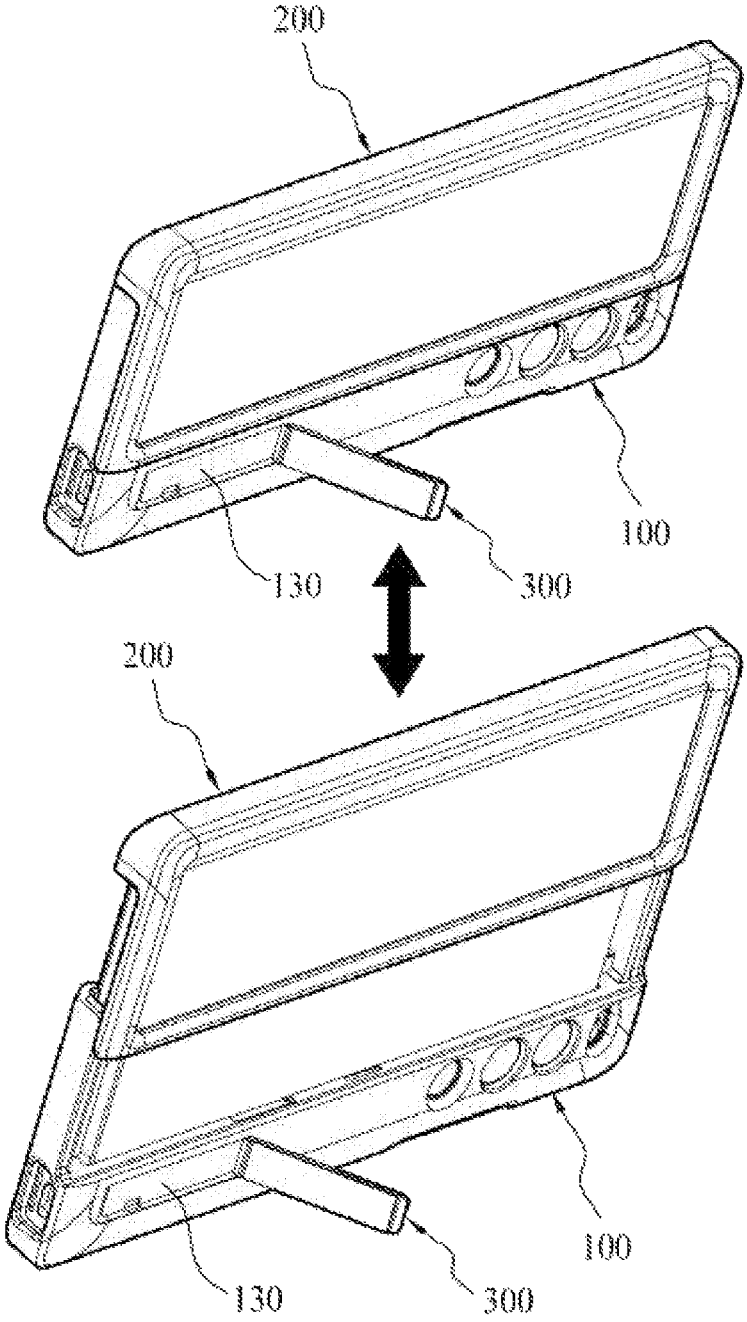
FIG. 4 shows a state in which a case for a rollable mobile device is erected by a stand unit according to an embodiment of the present invention.

FIG. 4 shows a state in which the case for a rollable mobile device according to an embodiment of the present invention is stood by the stand unit 400. Referring to FIG. 4, a case for a rollable mobile device according to an embodiment of the present invention includes a stand unit 400. The stand unit 400 supports the first case 100 to be stood at a predetermined angle. The stand unit 400 is hinged to the first case 100 and can rotate. In a state in which the stand unit 400 accommodated in the stand groove 130 is rotated, the stand unit 400 may serve as a support. The stand unit 400 supports the first case 100 in a reduced or expanded state of the display of the rollable mobile device M and can be stood at a predetermined angle. And the rollable mobile device M and the second case 200 are also erected at a predetermined angle accordingly. Therefore, the display of the rollable mobile device M can be maintained at a constant angle in both the reduced or expanded state.

Figure 5:
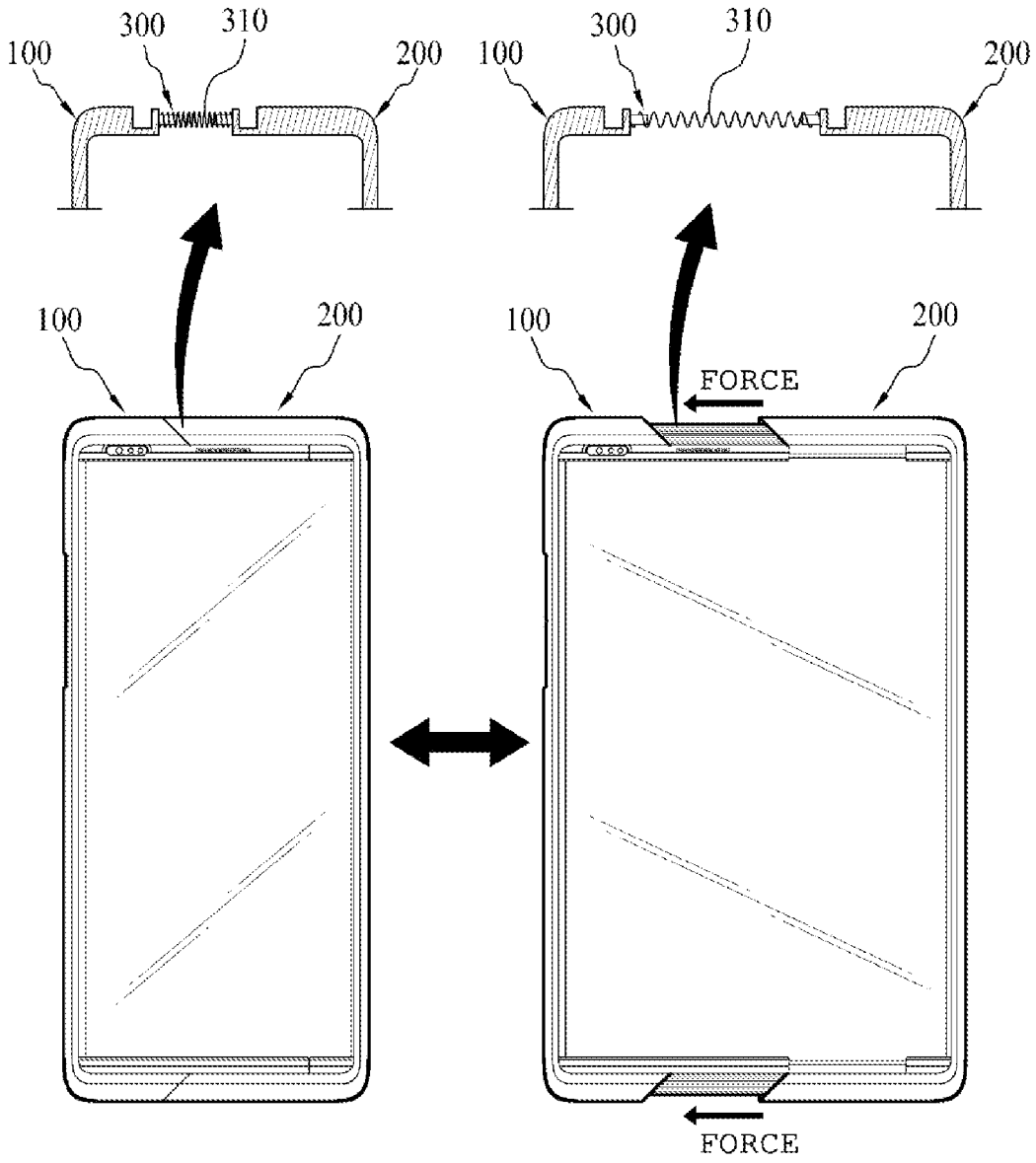
FIG. 5 is a diagram illustrating a state in which a case for a rollable mobile device according to an embodiment of the present invention is mounted on the rollable mobile device.

When the second body part 20 slides to expand the display in the rollable mobile device M, as shown in FIG. 1, the exposed portion 30 is exposed to the outside. As shown in FIG. 3, in a state in which the first case 100 and the second case 200 are separated, the exposed portion 30 of the expanded display cannot be protected. In order to protect the exposed portion 30, the second case 200 may surround the exposed portion 30 as shown in FIG. 5. However, when the second body part 20 slides back to its original position in order to reduce the display, at least one surface of the second case 200 and the first case 100 come into contact with each other and frictional force is generated. In addition, a problem occurs in that the second case 200 is separated from the second body part 20 due to such frictional force. This is because, when the second case 200 surrounds the exposed portion 30, the second case 200 slides while covering at least a part of the first case 100. In particular, in order not to cover the display module of the rollable mobile device M, the edge part of the second case 200 has to be relatively thin, so it is difficult to maintain the state mounted on the second body part 20 only by forced fitting. That is, when the first case 100 is extended to protect the exposed portion 30 exposed in the rollable mobile device M, a problem occurs that the second case 200 is separated from the second body part 20.

Figure 6:
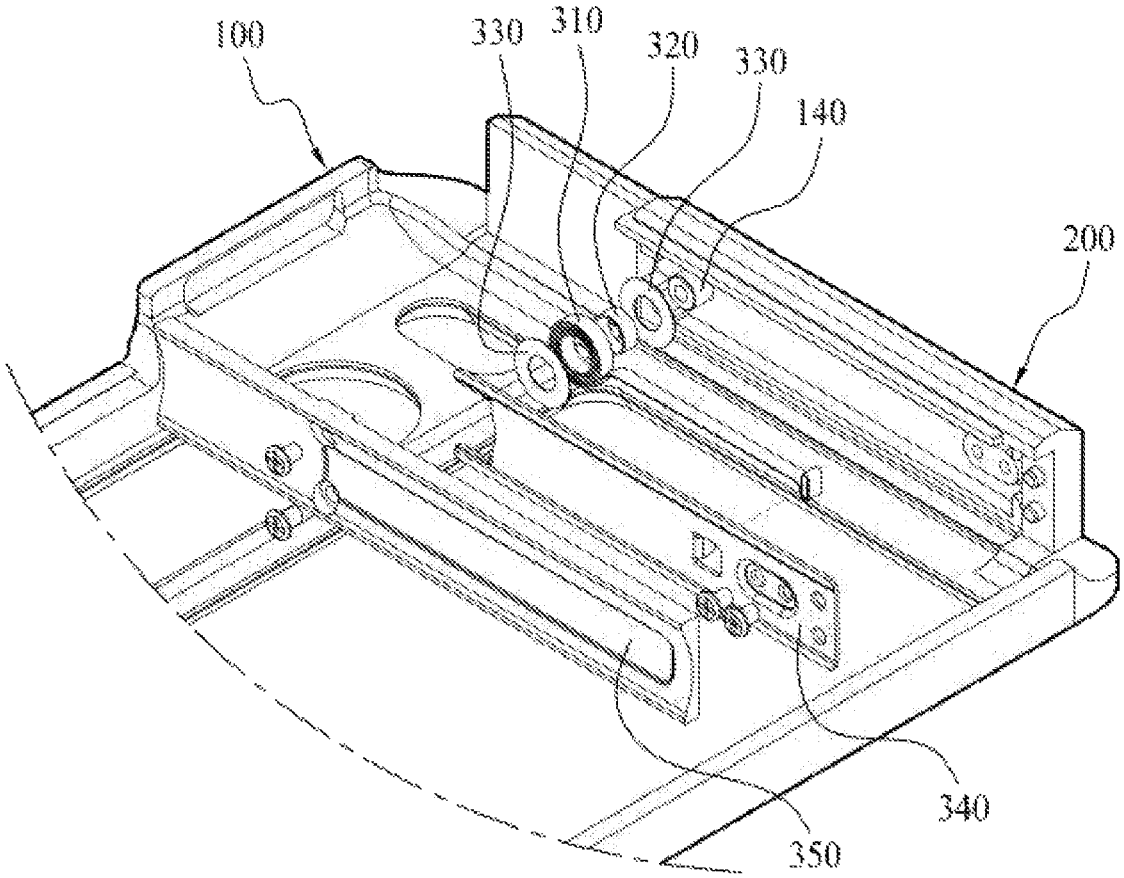
FIG. 6 shows the configuration of the holding part in the case for a rollable mobile device according to an embodiment of the present invention.

FIG. 5 shows a state in which a case for a rollable mobile device according to an embodiment of the present invention is mounted on the rollable mobile device M. And, FIG. 6 shows the configuration of the holding part 300 in the case for a rollable mobile device according to an embodiment of the present invention. A case for a rollable mobile device according to an embodiment of the present invention includes a holding part 300. The holding part 300 maintains the case not to be separated during sliding movement of the rollable mobile device M. In the embodiment of FIG. 5, the holding part 300 maintains the state in which the second case 200 is mounted on the second body part 20. More specifically, when the second case 200 moves from the second position to the first position, the holding part 300 provides a force that pulls the second case 200 in the direction of the first position. In this regard, the first position is a position where the second case 200 is mounted on the second body part 20 in a state in which the display is reduced. In addition, the second position is a position where the second case 200 is mounted on the second body part 20 in a state in which the display is expanded. The second case 200 slides from the first position to the second position by the extended length of the display of the rollable mobile device M. The holding part 300 maintains the second case 200 not to be separated from the second body part 20 due to frictional force. The force of the holding part 300 pulling the second case 200 in the direction of the first position is at least stronger than the frictional force. Accordingly, even if the second case 200 slides while covering at least a part of the first case 100, the second case 200 does not separate from the second body part 20 due to frictional force.

The holding part 300 may provide a force for pulling the second case 200 in the direction of the first position in various configurations. Referring to FIG. 5 and FIG. 6, for example, the holding part 300 may provide a pulling force by a spring 310. The spring 310 may include various types of springs, such as a compression spring, a tension spring, a torsion spring, and a spiral spring. FIG. 5 shows an embodiment using a tension spring as the spring 310, and FIG. 6 shows an embodiment using a spiral spring. As shown in FIG. 6, when the holding part 300 includes a spiral spring, the coil of the spiral spring can be inserted into a protrusion 140 formed inside the first case 100. Here, the bushing 320 can rotate around the protrusion 140 as a rotation axis while fixing at least a part of the inner portion of the spiral spring.

In addition, the outer portion of the spiral spring may be fixed to the second case 200 or the moving plate 340 sliding along the inner surface of the second case 200. The washer 330 may support the coil side of the spiral spring. As the second case 200 moves from the first position to the second position, the spiral spring may accumulate elastic energy and provide a force to pull the second case 200 in the direction of the first position. In addition, the spring may include a non-metal spring made of a material such as rubber, fluid and synthetic resin in addition to the metal spring. Multiple materials can be used in combination even in a single spring.

In an embodiment, while surrounding at least a portion of the outer circumference of the spiral spring, it may include a spring housing unit (not shown) formed with an outlet so that one end of the spiral spring can enter. The housing unit may limit the space in which the spiral spring can be maximally expanded so as to efficiently secure a space necessary for implementing the function of the spiral spring. In addition, various configurations that can act to convert the circumferential motion of the spiral spring into motion in a linear direction may be included.

In addition, the holding part 300 may provide a pulling force through an elastic material or a magnet. As the elastic material, for example, a material such as silicone or rubber may be used, and various materials having elasticity may be used.

In an embodiment, the holding part 300 may include a cover 350. The cover 350 covers at least one surface of the holding part 300 so that the holding part 300 can function stably in a separate space. In addition, it is possible to safely protect the rollable mobile device from scratches by preventing the holding part 300 from coming into direct contact with the rollable mobile device M.

The holding part 300 may have various embodiments according to the characteristics of the configuration that provides force to prevent the case from being separated. In addition, the holding part 300 may include various configurations capable of reducing frictional force generated during sliding movement of the case. If the frictional force is strong, the case may not only come off during sliding movement, but may also cause problems in sliding operation of the rollable mobile device M in the long term. Therefore, it is possible to prevent or minimize various driving defects that may occur in sliding movement of the case and the rollable mobile device M by reducing the frictional force. As a configuration for reducing frictional force or maintaining it below a certain level, the holding part 300 may include a low-friction material or have a low-friction structure. As the low friction material, a resin such as POM (Polyoxymethylene) or Teflon may be used, but is not limited thereto, and various materials capable of reducing frictional force may be used. The low-friction material is applied to one surface of the case where friction by sliding occurs, thereby effectively reducing frictional force. As a low-friction structure, the holding part 300 may include a sliding guide unit for guiding a sliding operation while reducing frictional force. The sliding guide unit may have various bearing structures capable of reducing frictional force, and may include a linear motion (LM) guide. In addition, it is possible to reduce frictional force by applying a lubricant to the configuration of the holding part 300. And, by applying a lubricant to the low-friction material and the low-friction structure, it is possible to more effectively reduce the friction force.

The holding part 300 is not limited to the above-described exemplary structure and material, and if it can provide a force to keep the case from being separated, the holding part 300 may be implemented in a configuration including various structures and materials.

In the foregoing examples and drawings, for convenience of description, the configuration in which the second body part 20 of the rollable mobile device M slides has been described as a reference, but in another embodiment, the first body part 10 may slide. Alternatively, the first body part 10 and the second body part 20 may slide at the same time. However, the configuration of the holding part 300 of the present invention can be equally applied to an embodiment in which the first body part 10 slides and an embodiment in which the first body part 10 and the second body part 20 slide at the same time.

Figure 7:
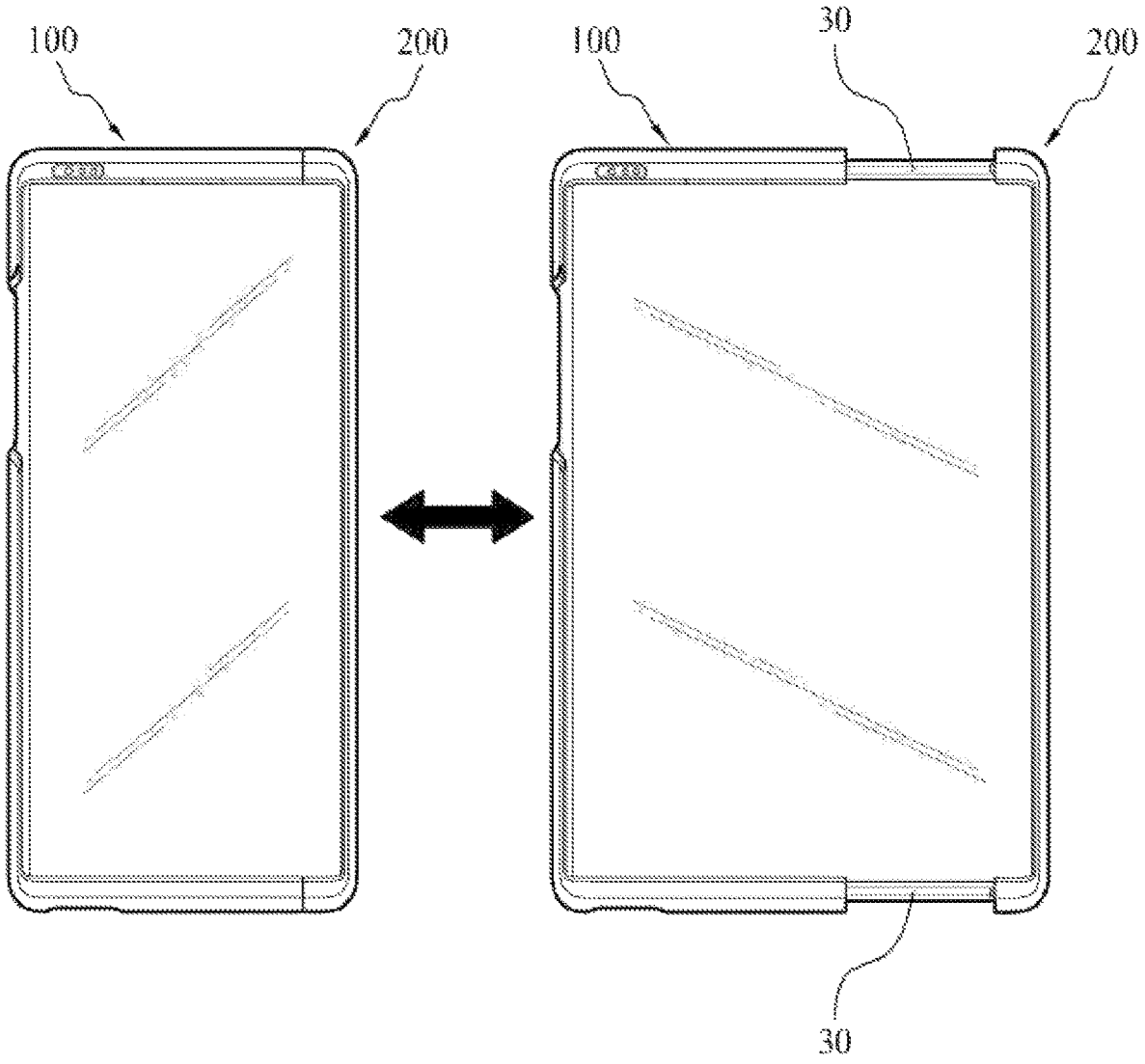
FIG. 7 is a diagram illustrating a state in which a case for a rollable mobile device according to an embodiment of the present invention is mounted on the rollable mobile device.
Figure 8:
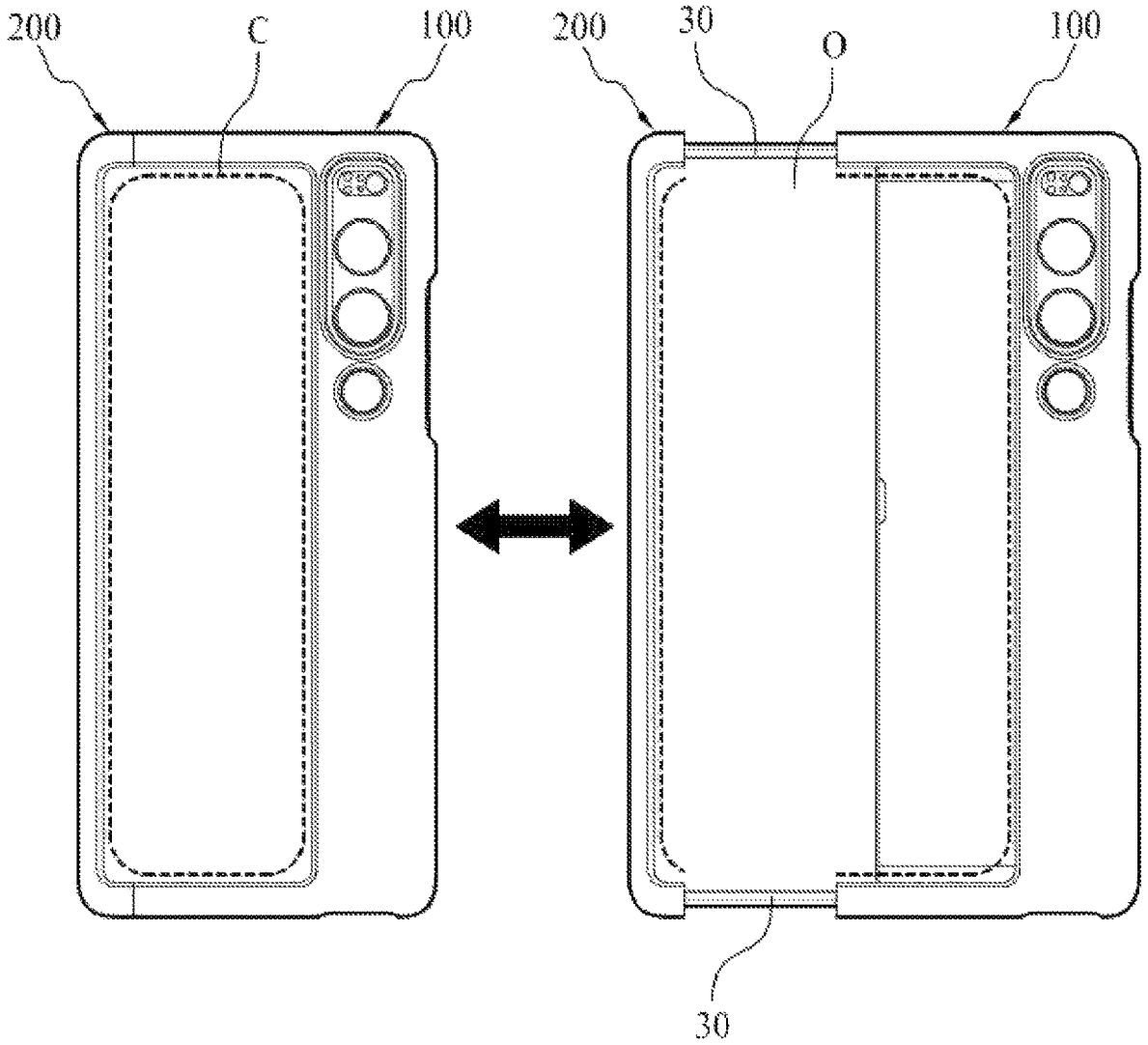
FIG. 8 shows a case for a rollable mobile device according to an embodiment of the present invention.

FIG. 7 shows a state in which a rollable mobile device case according to an embodiment of the present invention is mounted on the rollable mobile device M. And, FIG. 8 shows a case for a rollable mobile device according to an embodiment of the present invention. Referring to FIG. 7, in the case for a rollable mobile device according to an embodiment of the present invention, a first case 100 and a second case 200 are separated from each other. And referring to FIG. 8, at least one surface of the first case 100 and the second case 200 is opened. However, when the first case 100 and the second case 200 contact each other in a reduced display state, the closed area C is formed on one surface of the rollable mobile device M. Conversely, when the first case 100 and the second case 200 are separated from the display in an expanded state, an open area O is formed on one surface of the rollable mobile device M. Even if the relative positions of the first body part 10 and the second body part 20 are changed according to the expansion or contraction of the display, the separated first case 100 and second case 200 do not affect each other. Accordingly, the first case 100 or the second case 200 is not separated due to the frictional force.

Figure 9:
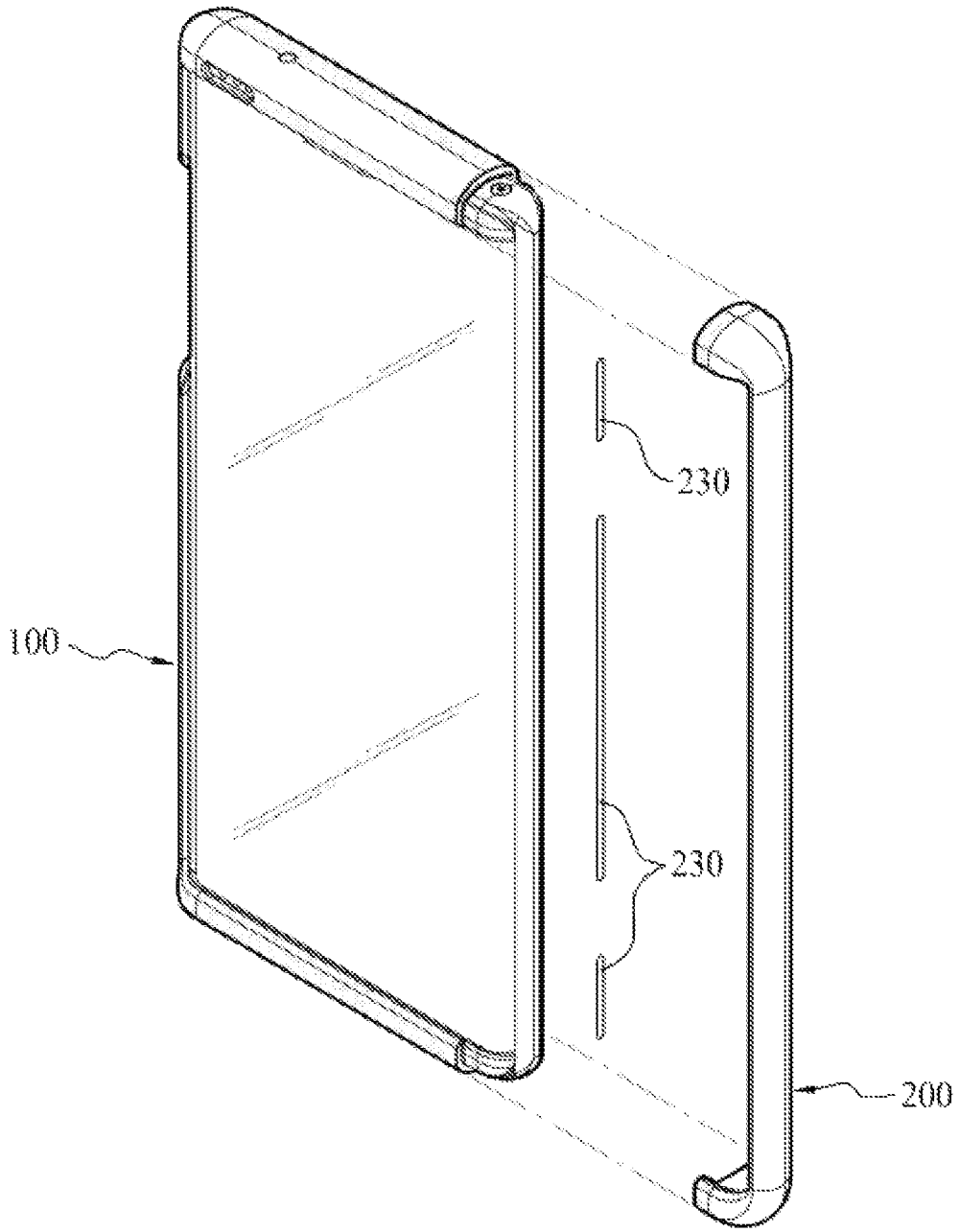
FIG. 9 is a diagram showing the configuration of a case for a rollable mobile device according to an embodiment of the present invention.

FIG. 9 shows the configuration of a case for a rollable mobile device according to an embodiment of the present invention. Referring to FIG. 9, the second case 200 includes a fixing part 230. The fixing part 230 fixes the second case 200 to the second body part 20. When one side of the second case 200 is opened, it is difficult for the second case 200 to be stably mounted on the second body part 20 only by forced fitting. The fixing part 230 fixes the second case 200 to be stably mounted on the second body part 20. In the embodiment of FIG. 9, although the fixing portion 230 is illustrated as a double-sided tape, if the second case 200 can be fixed to the second body part 20, any types of substance may be included in the fixing part 230.

According to the present invention, it is possible to safely protect the rollable mobile device M in response to a shape change that occurs when the display is expanded or reduced in the rollable mobile device M. In particular, the case does not come off from the rollable mobile device M while safely protecting the portion exposed by the extension of the display in the rollable mobile device M. Accordingly, the present invention can provide a full cover case that protects the entire rollable mobile device M.

The contents described in the description of the invention are merely examples, and the present invention may be variously modified and practiced by those skilled in the art. Therefore, the protection scope of the present invention is not limited to the description and expression of the described embodiments.

ANNOTATION

M: a rollable mobile device;
C: closed area;
O: open area;
10: a first body part;
20: a second body part;
30: an exposed portion;
100: a first case;
110: an edge part;
120: a first support part;
130: a stand groove;
140: a protrusion
200: a second case;
210: an edge part;
220: a second support part;
230: a fixing part;
300: a holding part;
310: a spring;

320: a bushing;
330: a washer;
340: a moving plate;
350: a cover;
400: a stand unit;
500: an air room; and
600: a pad part.

What is claimed is:

1. An expandable case for holding a rollable mobile electronic device, the expandable case comprising:

a first case configured to be mounted on a first body part of the rollable mobile electronic device, the first case including a first edge frame for surrounding an edge of the first body part and protruding higher than one surface of the first body part, the first case including a first support;

a second case configured to be mounted on a second body part of the rollable mobile electronic device, the second case including a second edge frame for surrounding an edge of the second body part and protruding higher than one surface of the second body part, the second case being slidably connected to the first case and including a second support; and a holding part configured to maintain the second case not to be separated from the second body part, wherein the holding part is configured to provide a force for the second case to return to a first position when the second case moves from the first position to a second position, wherein the holding part includes a tension spring having a first end and a second end, and wherein the first end of the tension spring is connected to an end of the first edge frame of the first case and the second end of the tension spring is connected to an end of the second edge frame of the second case.

2. The expandable case of claim 1, wherein the first case and the second case are made of a mixture of hard and soft materials, and wherein the first support and the second support are made of a steel material.

3. The expandable case of claim 1, further comprising:

a stand connected to the first case by a hinge to support the first case to be stood at a predetermined angle.

4. An expandable case for holding a rollable mobile electronic device the expandable case comprising:

a first case configured to be mounted on a first body part of the rollable mobile electronic device, the first case including a first edge frame for surrounding an edge of the first body part and protruding higher than one surface of the first body part, the first case including a first support;

a second case configured to be mounted on a second body part of the rollable mobile electronic device, the second case including a second edge frame for surrounding an edge of the second body part and protruding higher than one surface of the second body part, the second case being slidably connected to the first case and including a second support; and a holding part configured to maintain the second case not to be separated from the second body part, wherein the holding part is configured to provide a force for the second case to return to a first position when the second case moves from the first position to a second position, wherein the holding part comprises:

a spiral spring rotatably disposed on a protrusion protruding from an inner surface of the first case, a moving plate configured to slide along an inner surface of the second case, a protecting cover configured to cover the moving plate, and wherein an outer portion of the spiral spring is fixed to the second case or the moving plate.

5. The expandable case of claim 4, wherein the second case is configured to slide while covering at least a portion of the first case.

6. The expandable case of claim 4, wherein at least one side of the first case and the second case is opened.

* * * * *